United States Patent [19]

Pomeret et al.

[11] 3,964,182

[45] June 22, 1976

[54] MECHANICAL SHOVEL

[76] Inventors: Jean-Claude Pomeret, Saint.Lager, Belleville; Henry Bonnevaux, 98, rue Bechevelin, Lyon, both of France

[22] Filed: Oct. 29, 1974

[21] Appl. No.: 519,000

[30] Foreign Application Priority Data

Oct. 31, 1973 France ..... 73.39465

[52] U.S. Cl. ..... 37/1; 37/103; 37/116; 172/41; 224/5 B; 239/152; 254/139.1; 294/49

[51] Int. Cl.[2] ..... E02F 3/02; E02F 3/46; A01B 1/02; A01D 11/00

[58] Field of Search ..... 172/41, 370; 37/1, 103, 37/116, 118 R, 137, 195; 222/175; 221/185; 239/152–154, 653; 294/49, 54, 55, 58; 254/139.1; 244/151 R; 224/5 R, 5 BC, 5 B, 25 R, 25 A; 173/30

[56] References Cited

UNITED STATES PATENTS

| | | | |
|---|---|---|---|
| 2,520,431 | 8/1950 | Pierce | 254/139.1 X |
| 2,615,584 | 10/1952 | Adams | 254/139.1 X |
| 2,666,212 | 1/1954 | Flanders | 254/139.1 X |
| 2,750,666 | 6/1956 | Teagle | 172/41 X |
| 3,140,800 | 7/1964 | Henderson | 222/175 X |
| 3,424,134 | 1/1969 | Rosenblum | 244/151 R |
| 3,757,744 | 9/1973 | Prauaz | 244/151 R |

FOREIGN PATENTS OR APPLICATIONS

| | | | |
|---|---|---|---|
| 1,418,935 | 11/1965 | France | 37/1 |
| 513,357 | 2/1921 | France | 172/41 |
| 1,178,303 | 5/1959 | France | 172/41 |
| 76,086 | 12/1961 | France | 239/154 |
| 7,131 | 9/1956 | Germany | 239/154 |
| 63,752 | 3/1914 | Germany | 239/152 |

*Primary Examiner*—Edgar S. Burr
*Assistant Examiner*—Steven A. Bratlie
*Attorney, Agent, or Firm*—Karl F. Ross; Herbert Dubno

[57] ABSTRACT

A mechanical shovel comprises a digging tool, two booms and a harness. One of the booms is adapted to be mounted by the harness on and substantially parallel to the back of an operator so that the other boom extends forwardly of the operator. One of the booms supports a winding mechanism having a cable leading along the forwardly extending boom and attached to the handle of the digging tool. The handle of the digging tool is provided with means to activate the winding mechanism so that the shovel may be raised with the minimum of effort on the part of the operator. The combination of the two booms provides a particularly stable arrangement.

4 Claims, 4 Drawing Figures

MECHANICAL SHOVEL

FIELD OF THE INVENTION

The present invention relates to a portable shovel capable of motorized operation and more particularly to a digging tool of the type comprising a so-called shovel with handle terminating in two small grips enabling the operator to hold the latter with both hands and a harness allowing the operator to carry on his back a winch with its drive means. The winch comprises a support extending above the operator and has a cable whose end is fixed to the handle of the shovel. Control means for the winch is located on the small grips.

BACKGROUND OF THE INVENTION

A portable shovel of this type is already described in French Patent No. 1,418,935 of Oct. 5th 1964 in the name of Mr. Henry BONNEVAUX. Owing to its motorized operation, this shovel reduces muscular exertion by the operator, while enabling him to work more quickly and with the same accuracy as with an ordinary shovel. An apparatus of this type is particularly intended for removing earth in trenches, work which normally requires considerable muscular exertion since it is necessary to raise the shovel and its contents. This type of work also requires some accuracy owing to the fact that the bottom of a trench is not easily accessible. With a shovel of the aforesaid type, the operator need solely to control the winding of the winch cable to obtain the ascent of the shovel handle and thus raise the load.

The portable shovel described in the above-mentioned French Patent nevertheless has a certain drawbacks. In particular, the support extends only vertically above the operator and the arrangement constituted by the support, the cable and the shovel handle forms a triangular structure of which the side corresponding to the cable is highly inclined to the vertical. This is a disadvantage since force components are generated which unbalance the operator. The oblique direction of the cable is also dangerous for the operator, since the cable passes close to his face and there is a danger of injury.

OBJECT OF THE INVENTION

The object of the present invention is to eliminate these drawbacks and to provide a portable shovel of the aforesaid type which is perfectly balanced and is easy and reliable to use.

SUMMARY OF THE INVENTION

According to the present invention the mechanical shovel comprises a digging tool, first and second articulated booms and a harness. The first boom is mounted on and substantially parallel to the back of an operator by means of the harness so that the second boom extends forwardly of the operator. The digging tool has a handle which is attached to one end of a cable lifting means at an intermediate portion of the handle. The other end of the cable is attached to winding means supported by one of the booms. The handle is provided with manual control means to activate said winding drum to cause the digging tool to be moved by the cable.

Because of the use of the second boom, which normally extends horizontally or obliquely above and in front of the operator, the cable from the tool handle to the boom is substantially vertical. The arrangement constituted by the two booms, the cable and the shovel handle thus forms a quadrilateral. Any pulling force towards the front or rear when the loaded shovel is raised, is thus eliminated and there is no danger of the operator becoming unbalanced. Furthermore, the cable is located sufficiently far in front of the operator to prevent any danger of injuring the latter.

In the transportation position, the support for the digging tool has only slight bulk since its normally horizontal or oblique part (second boom) may be folded back against the harness. The device thus forms a compact arrangement which may be easily stored in an appropriate cover.

According to a preferred embodiment, the vertical part of the support is pivotally mounted with respect to the harness, such that the entire support is free to turn. This pivoting gives the operator maximum freedom of action.

Advantageously, the cable is connected to the digging tool, e.g. a shovel, by means of a spring device. This device makes it possible to dampen starting-up and braking shocks.

According to another feature of the invention, the winding drum of the winch and its drive means are arranged adjacent a pivotal connection of the two booms which allows the booms to be folded together. This arrangement makes it possible to have a better balanced assembly, which is more compact and simplified with respect to the shovel of French Patent No. 1 418 935 in which the drive means are located on the operator's back.

To provide a maximum supporting surface, the harness of the shovel according to the invention is advantageously composed of a back plate, shoulder-pieces and straps. The straps preferably include a ventral strap and belts passing between the thighs.

BRIEF DESCRIPTION OF THE DRAWING

The invention will be better understood from the ensuing description, referring to the accompanying diagrammatic drawing illustrating, as a non-limiting example, an embodiment of the portable shovel. In the Drawing

SPECIFIC DESCRIPTION

Figure 1:
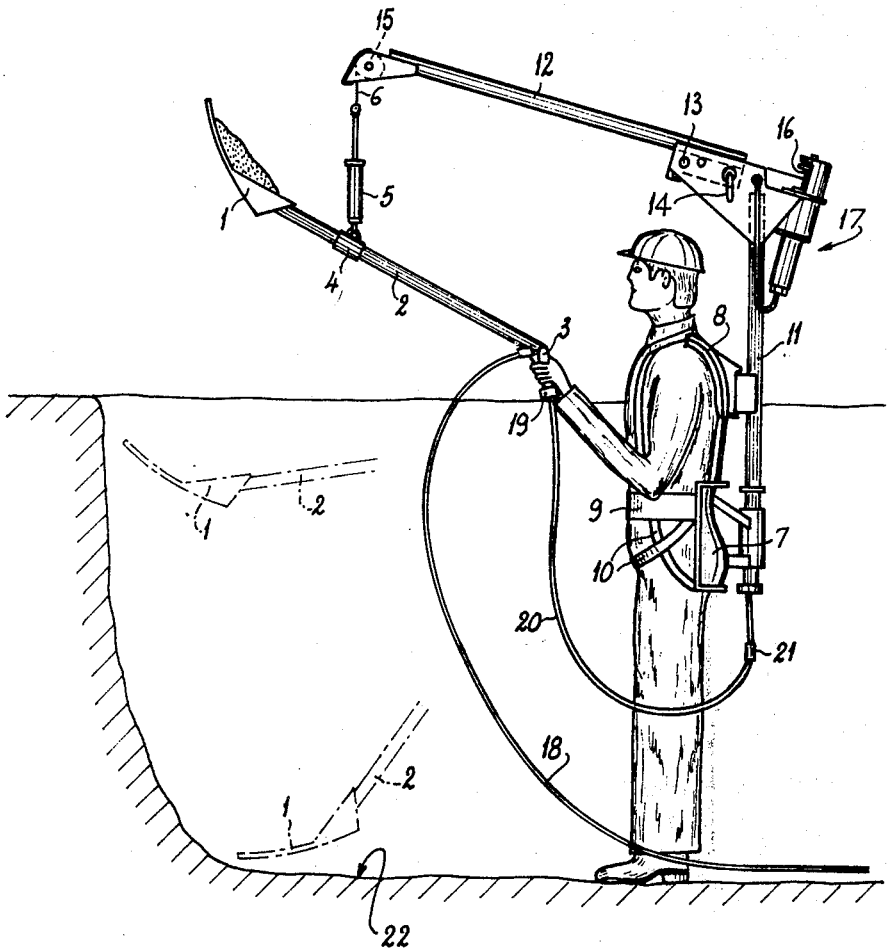
FIG. 1 is a side view of the shovel in the position of use.
Figure 2:
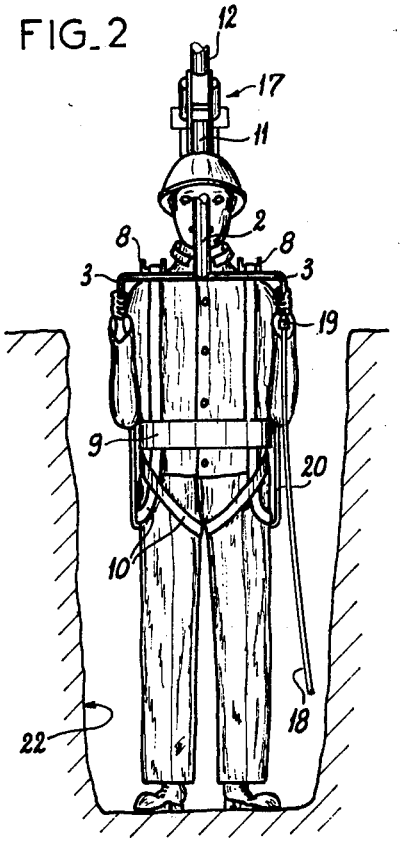
FIGS. 2 and 3 are respectively front and rear views corresponding to FIG. 1.
Figure 3:
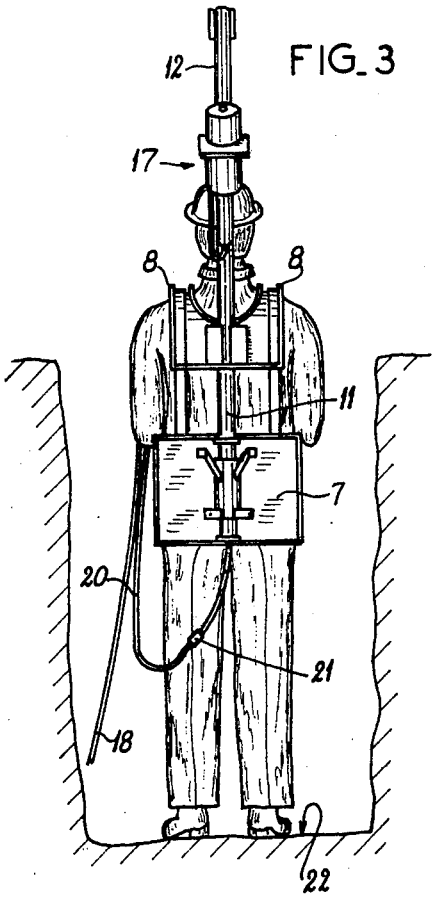

The apparatus according to the invention comprises a tool 1 called a "shovel" hereafter, but which may have variable shapes: e.g. ordinary shovel, small bucket, fork. The handle 2 of this shovel terminates in two small grips 3 forming a type of handle-bar and enabling the operator to grip the latter.

An intermediate point 4 of the handle 2 is connected by means of a spring mechanism 5 to the end of a cable 6 forming part of a winch mechanism which the operator carries on his back.

The operator carries a harness composed of a back plate 7, shoulder-pieces 8 and a certain number of straps, including a ventral strap 9 and belts 10 passing between his thighs.

Figure 4:
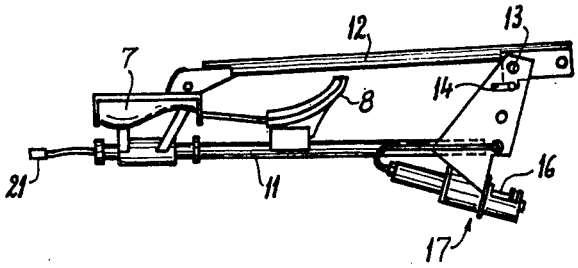
FIG. 4 shows the same shovel in the folded transportation position.

Fixed to the back plate 7 and shoulder-pieces 8 is the vertical part (first boom) 11 of a support. This vertical part is extended by another part (second boom) 12 which in the example illustrated is oblique, but which may also be horizontal. The second boom extends above the operator and in front of the latter. The oblique part (second boom) 12 of the support is pivoted to the vertical part (first boom) 11, about a pin 13, in order to be able to be folded against the harness in the position for transporting the apparatus, as shown in FIG. 4. A pin 14 makes it possible to immobilize the two parts (booms) 11 and 12 with respect to each other, either in the position of use or in the folded transportation position.

The cable 6 passes over a pulley 15 mounted at the end of the oblique part (second boom) 12 of the support and it winds onto a winding drum 16 located in the vicinity of the pivot point of the two parts (booms) 11 and 12 of the support. The drum 16 is connected to drive means 17 comprising a motor and a centrifugal clutch.

In the example illustrated, the motor is pneumatic. It is supplied by an air compressor (not shown), connected to the apparatus by a conduit 18 ending in manual control means 19 arranged on one of the small handles 3. A conduit 20, ending in a connection 21, connects these control means to the base of the support.

The operation of the apparatus is thus motorized. The operator, having filled the shovel 1, progressively actuates its distributor control located at 19 to actuate the pneumatic motor. The centrifugal clutch is thrown into operation progressively and whilst accelerating drives the winding drum 16. As it winds, the cable 6 raises the shovel 1. Once the shovel is raised to the desired height, owing to the control of the distributor, the operator maintains a sufficient force for the shovel 1 to remain in the waiting position. By rotating the handles 3, the operator directs the shovel 1 to the left or right to empty its contents. The vertical part 11 of the support may be pivotally mounted with respect to the harness such that the entire support is free to turn, thus facilitating the rotation of the shovel 1.

Then, the operator releases the control of the distributor and the shovel descends simply under gravity. It is also possible to use a motor having two directions of rotation, acting both during ascent and descent, and a pneumatic control allowing this reversal.

The satisfactory operation of the arrangement is ensured:

Firstly by the quadrilateral formed by the two parts 11 and 12 of the support, the cable 6 and the handle 2, making it possible to obtain practically vertical pulling of the cable 6 which prevents any forward or rearward traction.

Secondly by the combination of the distributor control, of the centrifugal clutch or any other type of clutch and of the spring mechanism 5 making it possible to obtain extremely progressive starting and thus to eliminate jerks.

This portable shovel is designed for all uses of picking-up or handling materials, but more particularly for removing earth easily in a trench 22 which may have a depth of up to approximately 1.50.m. The apparatus considerably improves the output of a navvy, while eliminating significant muscular exertion.

Naturally, the invention is not limited to the single embodiment of this shovel described above as a non-limiting example; on the contrary, it includes all variations.

Thus, the "shovel" arrangement may be axial, as in the example illustrated, or offset to the side, may be able to pivot or may be fixed. The drive means may be pneumatic, hydraulic, electrical or thermic and similarly it would not be outside the invention to replace certain details of the embodiments above-described by equivalent measures all within the scope of the appended claims. Thus, it is possible to provide safety devices on the apparatus, in particular means capable of stopping the movements automatically at the end of travel.

We claim:

1. A mechanical shovel to be carried by and manipulated by an operator, said mechanical shovel comprising:

a harness to be carried by said operator and including a back plate which rests against the lower back of the operator, a pair of shoulder pieces which engage over the shoulders of the operator and straps which retain said back plate and said shoulder pieces on the torso of the operator, said straps including a ventral strap and a pair of leg straps which extend around the thighs of the operator;

a first substantially vertical boom mounted at its lower end on said back slate and secured by said harness onto the operator, said first boom having an upper end disposed above the head of the operator;

a second boom extending from said upper end of said first boom over the operator and having a free extremity disposed forwardly of the operator;

pivot means articulating said second boom to said upper end of said first boom and means for locking said first and second booms relatively in an angular relationship;

a winch having a motor carried by one of said booms;

a cable mounted to said winch and passing along said second boom and extending downwardly from said free extremity ahead of the operator to an end, and drawn in upon operation of said motor;

a digging tool having a ground-engaging working end, a handle extending from said working end, and a pair of spaced-apart handle grips secured to said handle remote from said working end;

means for securing said cable end to said handle intermediate said working end and said hand grips; and control means on at least one of said hand grips for operating said motor.

2. The mechanical shovel as defined in claim 1 wherein said first boom is rotatable about its longitudinal axis relative to said back plate.

3. The mechanical shovel as defined in claim 1 wherein said means securing said cable end to said handle includes a spring mechanism.

4. The mechanical shovel as defined in claim 1 wherein said winch is disposed adjacent said pivot means on one of said booms.

* * * * *